US005450181A

United States Patent [19]

Tsukida et al.

[11] Patent Number: 5,450,181

[45] Date of Patent: Sep. 12, 1995

[54] FIXING DEVICE

[75] Inventors: Shinichi Tsukida, Yono; Koichi Tanigawa, Tokyo; Masahiro Goto, Yokohama; Hiromichi Tsujii, Tokyo; Satoru Izawa, Yokohama, all of Japan

[73] Assignee: Canon Kabushiki Kaisha, Tokyo, Japan

[21] Appl. No.: 230,906

[22] Filed: Apr. 21, 1994

[30] Foreign Application Priority Data

May 11, 1993 [JP] Japan ..... 5-109352
Oct. 21, 1993 [JP] Japan ..... 5-285552

[51] Int. Cl.[6] ..... G03G 13/20

[52] U.S. Cl. ..... 355/282; 355/285; 492/27; 492/46; 492/30; 219/216; 432/60

[58] Field of Search ..... 355/282, 285, 290; 226/184, 190; 219/216; 432/60; 492/27, 28, 30, 46, 60; 118/60

[56] References Cited

U.S. PATENT DOCUMENTS 4,540,267 9/1985 Moser ..... 432/60 X
4,682,878 7/1987 Takizawa et al. ..... 432/60 X
4,804,576 2/1989 Kuge et al. .
4,883,715 11/1989 Kuge et al. ..... 219/216 X
5,001,401 4/1991 Sakurai et al. ..... 355/282 X
5,130,754 7/1992 Hishikawa .
5,153,660 10/1992 Goto .
5,217,532 6/1993 Sasame et al. ..... 118/60 X
5,264,902 11/1993 Suwa et al. ..... 355/282

FOREIGN PATENT DOCUMENTS 60-14272 1/1985 Japan .
2-262684 10/1990 Japan .

*Primary Examiner*—R. L. Moses
*Attorney, Agent, or Firm*—Fitzpatrick, Cella, Harper & Scinto

[57] ABSTRACT

In a fixing device, a core material of a fixing rotating member has two largest-diameter portions respectively located between a central portion and each end portion of the fixing rotating member, within a region where a recording material of a largest size passes, and the diameter of each core material is gradually reduced from the largest-diameter portion toward the central portion and toward the nearest end portion. The outer shape of the fixing rotating member conforms to the shape of the core material. According to this configuration, it is possible to prevent corrugation and curl of the recording material, and to provide excellent mountability of the recording material.

49 Claims, 10 Drawing Sheets

FIXING DEVICE

BACKGROUND OF THE INVENTION

1. Field of the Invention

This invention relates to a fixing device included in an image forming apparatus which adopts an electrophotographic method, an electrostatic recording method, or the like. More particularly, the invention relates to a heating fixing device which includes by a fixing member and a pressing member disposed in pressure contact with each other.

2. Description of the Related Art

Among conventional fixing devices included in image forming apparatuses which adopt an electrophotographic method, an elestrostatic recording method, or the like, so-called heating fixing devices are widely used. In such devices, an unfixed toner image carried on a transfer material is fixed as a permanent image by passing the transfer material through a nip portion formed by a fixing roller and a pressing roller which rotate in pressure contact with each other. In such a heating fixing device, in order to prevent creases in the transfer material produced by passing it through the nip portion, at least one of the fixing roller and the pressing roller is generally configured in a so-called inverse-crown shape, in which the outer diameter at two end portions in the longitudinal direction is greater than has a the outer diameter at a central portion has a. However, the roller having such a configuration forcedly stretches the transfer material in the longitudinal direction of the roller, so that two end portions of the transfer material, which is not rigid, are corrugated, thereby degrading, in some cases, the quality of the obtained image. In order to prevent such corrugation, a proposal has been disclosed in U.S. Pat. No. 5,130,754 (Japanese Patent Laid-open Application (Kokai) No. 2-262684 (1990)), in which the largest-diameter portions of a pressing roller configured in the inverse-crown shape are positioned inside the two ends of the roller to form slight stripes at portions of the transfer material facing the largest-diameter, so that two end portions of the transfer material are strengthened.

However, detailed research conducted by the inventors of the present application have shown that even in the above-described proposal, when the size of the fixing device is reduced so as to provide a personal-use image forming apparatus, the following problems arise.

That is, when the diameter of the fixing device is reduced in order to provide a small image forming apparatus, the mechanical strength of the fixing roller is reduced. Hence, the fixing roller in pressure contact with the pressing roller is bent in the shape of a bow, whereby a greater amount of pressure and heat are supplied to two end portions of the transfer material. As a result, fibers of the transfer material are greatly stretched, whereby a curve of the output transfer material toward its non-printed surface (so-called inverse curl) is apt to be produced. This inverse curl cannot be completely removed even by inverse-curl correction means particularly in an image forming apparatus, in which sheets are frequently discharged in a face-up state, such as a printer for a personal computer. Hence, the mountability of sheets in the apparatus is inferior. When sheets of the transfer material are discharged in a face-up state, the discharged sheets curl, whereby the quality of obtained images are remarkably degraded.

When the diameter of the pressing roller is reduced as well as the fixing roller, the hardness of the pressing roller must have a small value in order to maintain a nip width sufficient for fixing an unfixed toner image on the transfer material. In such a case, even if the shape of end portions of the pressing roller is changed as disclosed in the above-described proposal, the effect of the change is weakened, and "corrugation" is apt to be produced.

Furthermore, it is very difficult, from the viewpoint of accuracy, to finely adjust and form the shape of two end portions of the pressing roller made of an elastic material in a manner as disclosed in the above-described proposal, and therefore the productivity of the device is inferior.

Thus, it has become clear that in the device disclosed in the above-described proposal, the proposed effect is insufficient prevent corrugation at end portions of the recording material. If output sheets having corrugation at end portions are, for example, superposed and bound, ends of the bound sheets are not exactly aligned, thereby presenting an awkard appearance. Such a phenomenon is more pronounced as the outer diameter of the fixing roller is smaller. Recently, this phenomenon is apt to arise more frequently because the diameters of the fixing roller and the pressing roller are becoming smaller as the size of the heating fixing device is reduced as a result of development of personal-use electrophotographic printers, copiers and the like.

SUMMARY OF THE INVENTION

It is an object of the present invention to provide a fixing device in which corrugation and inverse curl of a recording material are prevented.

It is a further object of the present invention to provide a fixing device in which the outer shape of a fixing rotating member conforms to the shape of a core material having a largest-diameter portion between a central portion and each end portion.

It is a still further object of the present invention to provide a fixing device in which corrugation at end portions of a recording material is prevented.

It is still another object of the present invention to provide a fixing device in which the inclination of portions outside largest-diameter portions of a fixing rotating member is defined.

It is still a further object of the present invention to provide a fixing device in which a fixing rotating member has a plurality of inclined portions corresponding to end portions of a plurality of recording materials.

It is yet another object of the present invention to provide a fixing device in which each of a fixing rotating member and a pressing rotating member has a plurality of inclined portions corresponding to end portions of a plurality of recording materials.

According to one aspect, the present invention which achieves these objectives relates to a fixing device comprising a fixing rotating member comprising a core material and a resin layer provided thereon, and a pressing rotating member comprising a rubber layer for forming a nip with the fixing rotating member. A fixing operation is performed by grasping and conveying a recording material carrying an unfixed image by the nip. The core material of the fixing rotating member has a largest-diameter portion between a central portion and each end portion within a region where a recording material of the largest size passes. The diameter of the core material is gradually reduced from the largest-diameter portion toward the inside and the outside. The outer shape of the fixing rotating member conforms to the shape of the core material.

According to another aspect, the present invention relates to a fixing device comprising a fixing rotating member for contacting an unfixed image, and a pressing rotating member, whose hardness is lower than the hardness of the fixing rotating member, for forming a nip with the fixing rotating member. A fixing operation is performed by grasping and conveying a recording material carrying the unfixed image by the nip. The fixing rotating member has a largest-diameter portion between a central portion and each end portion within a region where a recording material of the largest size passes. The diameter of the fixing rotating member is gradually reduced from the largest-diameter portion toward the inside and the outside. In one embodiment, the pressing rotating member has substantially a straight shape or inverse-crown shape. In another emodiment, the hardness of the pressing roller is at least 30° and equal to or less than 70°. In still another embodiment, the outer diameter of the fixing rotating member is equal to or less than 30 mm. In yet another embodiment, the inclination of the fixing rotating member from the largest-diameter portion toward the outside is at least 0.02 and equal to or less than 0.2. In still further embodiment, the inclination of of the fixing rotating member from the largest-diameter portion toward the outside is at least 20 times and equal to or less than 300 times the inclination of the fixing rotating member from the largest-diameter portion toward the inside. In yet a further embodiment, the inclination of the fixing rotating member from the largest-diameter portion toward the outside is constant or increases toward each end portion. In still a further embodiment, the diameter of the pressing rotating member at a portion corresponding to the neighborhood of an and of the recording material is reduced from the innside toward the outside of the end of the recording material.

According to still another aspect, the present invention relates to a fixing rotating member for contacting an unfixed image, and a pressing rotating member for forming a nip with the fixing rotating member. A fixing operation is performed by grasping and conveying a recording material carrying the unfixed image by the nip. The diameter of the fixing rotating member is reduced from the innside toward the outside at each portion corresponding to the neighborhood of an end of each of a plurality of recording materials of different sizes.

The foregoing and other objects, advantages and features of the present invention will become more apparent from the following detailed description of the preferred embodiments taken in conjuction with the accompanying drawings.

DETAILED DESCRIPTION OF THE PREFERRED EMBODIMENTS

First Embodiment

Figure 1:
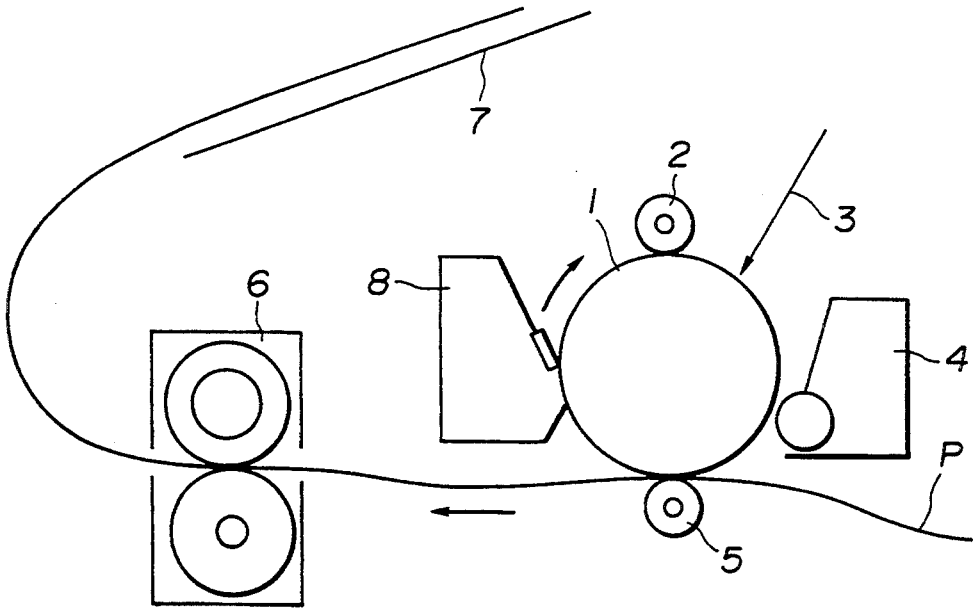
FIG. 1 is a diagram illustrating the configuration of an image forming apparatus according to a first embodiment of the present invention.

FIG. 1 is a diagram illustrating the configuration of a principal portion of an image forming apparatus which includes a fixing device according to a first embodiment of the present invention.

In FIG. 1, a photosensitive drum 1 comprises a photosensitive material, such as an OPC (organic photoconductor), amorphous Se, amorphous Si or the like, formed on a cylindrical base made of aluminum, nickel or the like. The photosensitive drum 1 is rotatably driven in the direction of the arrow. First, the surface of the photosensitive drum 1 is uniformly charged by a charging roller 2, serving as a charging device. Then, scanning exposure by a laser beam 3 subjected to on-off control in accordance with image information is performed to form an electrostatic latent image. The electrostatic latent image is developed and visualized by a developing device 4. A jumping developing method, a two-component developing method, a FEED developing method or the like is used as the developing method. In many cases, image exposure and reverse development are combined.

The visualized toner image is transferred by a transfer roller 5, serving as a transfer device, onto a transfer material P, serving as a recording material, conveyed at a predetermined timing. The transfer material P, on which the toner image has been transferred, is conveyed to a fixing device 6, where the toner image is fixed as a permanent image. Thereafter, the transfer material P is discharged onto a sheet-discharging tray 7 in a so-called face-down state. Toner particles remaining on the photosensitive drum 1 are removed from the surface of the photosensitive drum 1 by a cleaning device 8.

Figure 2:
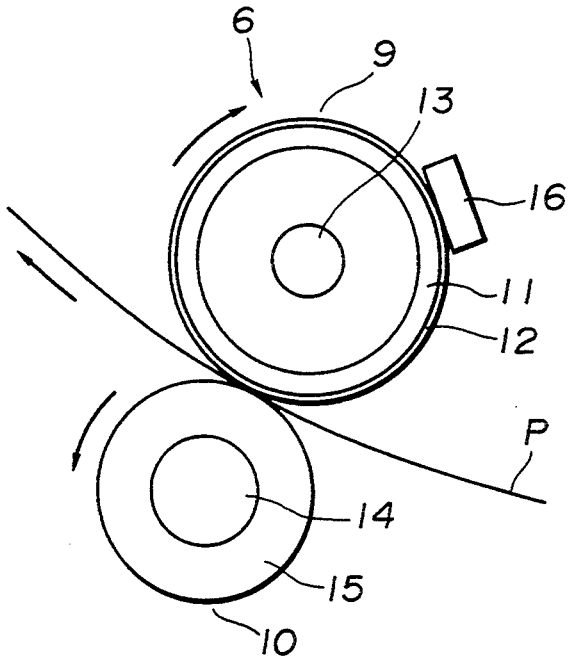
FIG. 2 is a heating fixing device according to the first embodiment.

FIG. 2 illustrates the configuration of the heating fixing device 6 of the present embodiment. In FIG. 2, a fixing roller 9 and a pressing roller 10 rotate in the directions of the respective arrows. The fixing roller 9 comprises a layer 12 of PFA, which is a fluororesin having excellent releasability, 30 μm thick coated on the surface of a hollow core bar 11, made of alluminum which has excellent heat resistance, 2 mm thick having an inner diameter of 26 mm. A halogen-lamp heater 13 for heating the fixing roller 9 is disposed within the hollow core bar 11. The hardness of the surface of the fixing roller 9 is at least 90° (measured by a JIS (Japanese Industrial Standards) A hardness meter). The pressing roller 10 comprises a layer 15 of silicone rubber, which has excellent releasability, 10 mm thick formed on the outer circumference of a core bar 14, made of iron, having an outer diameter of 10 mm, and has the so-called inverse-crown shape, in which the difference between the diameter at largest-diameter portions situated at two end portions in the longitudinal direction and the diameter at a smaller-diameter portion situated at a central portion equals 0.2 mm. The hardness of the pressing roller 10 is 50° (ASKER C hardness at a load of 500 gf). The fixing roller 9 and the pressing roller 10 are in pressure contact with each other by a spring (not shown) at respective two end portions in the longitudinal direction. A thermistor 16 for detecting the surface temperature of the fixing roller 9 contacts the fixing roller 9. Information relating to the surface temperature of the fixing roller 9 detected by the thermistor 16 is transmitted to a CPU (central processing unit, not shown) via an A/D (analog-to-digital) converter (not shown). The CPU performs on-off control of the halogen-lamp heater 13 via an AC driver (not shown), so that the surface temperature of the fixing roller 9 is controlled at a predetermined value.

Figure 3:
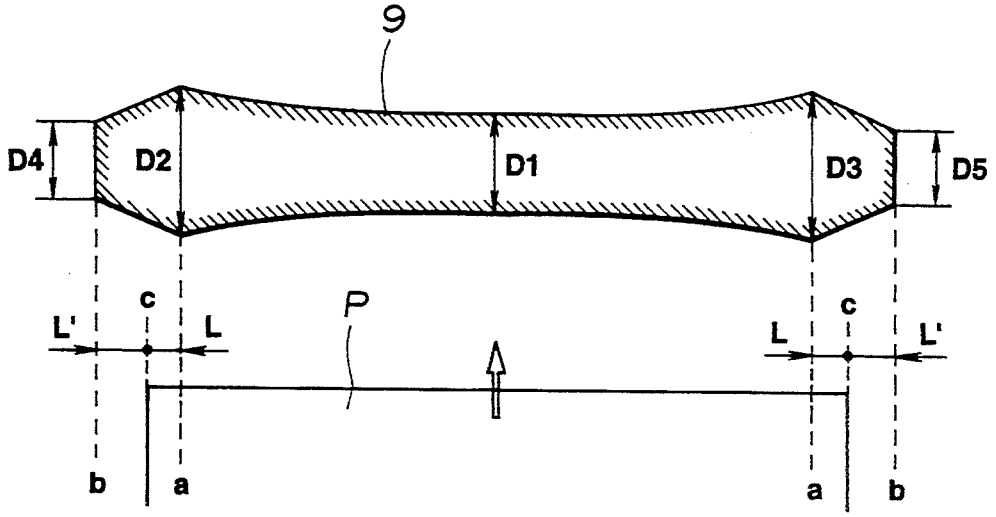
FIG. 3 is a diagram illustrating the shape of a fixing roller of the heating fixing device shown in FIG. 2.

The shape of the fixing roller 9 included in the heating fixing device of the present embodiment will now be described in detail with reference to FIG. 3.

In order to prevent the occurrence of creases in the transfer material P, the fixing roller 9 has the inverse-crown shape, in which the outer diameter at a central portion in the longitudinal direction is smaller than the diameter at largest-diameter portions, and the largest-diameter portions are situated outside the central portion and inside the two ends in the longitudinal direction. More specifically, the outer diameter $D_1$ at the smallest-diameter portion is 30 mm, the outer diameters $D_2$ and $D_3$ at the largest-diameter portions "a" equal 30.25 mm, and the outer diameters $D_4$ and $D_5$ at the two ends b equal 29.4 mm. The largest-diameter portions "a" are inside positions c where the two ends of a transfer material P having the largest width pass. The distance L between positions "a" and c is 4 mm. The positions c where the two ends of the transfer material P having the largest width pass are inside the two ends b of the fixing roller 9. The distance L' between positions b and c is 3 mm.

In order to provide the above-described shape, the core bar 11 is processed in a shape having diameters smaller than the above-described values by $30\times2=60$ μm, and a releasing resin layer having a substantially uniform thickness is provided on the core bar 11. Thus, the above-described outer shape conforming to the shape of the core bar 11 is obtained.

That is, in the present embodiment, the core bar 11 has largest-diameter portions between a central portion and the two ends within the region where the recording material having the largest width passes, and the diameter of the core bar 11 is gradually reduced from the largest-diameter portions toward the central portion and toward the two ends. The resin layer 12 provided on the core bar 11 conforms to the shape of the core bar 11. Hence, the fixing roller 9 has the above-described shape.

Figure 4:
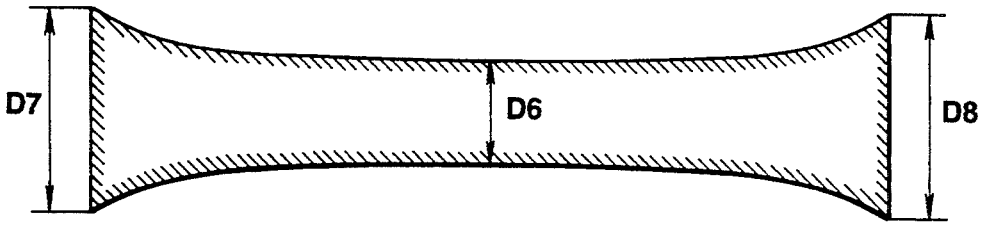
FIG. 4 is a digram illustrating the shape of a fixing roller of a conventional heating fixing device, serving as a comparative example.
Figure 5:
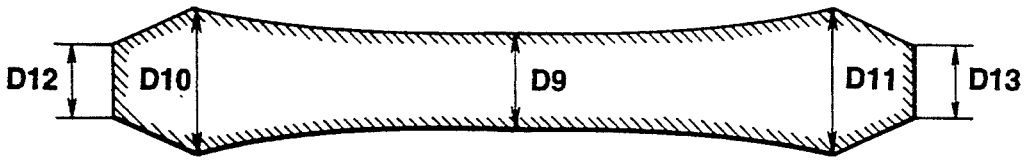
FIG. 5 is a diagram illustrating the shape of a pressing roller of the conventional heating fixing device, serving as a comparative example.

The effects of the present invention will now be described indicating results of experiments of comparison with a conventional heating fixing device obtained by the present inventors. The conventional heating fixing device used for the purpose of comparison comprises a fixing roller having an inverse-crown shape, in which, as shown in FIG. 4, the outer diameter at the center in the longitudinal direction has a smaller value ($D_6=30$ mm), and the outer diameter at the two ends has a largest value ($D_7$, $D_8=30.3$ mm), and a pressing roller having an inverse-crown shape, in which, as shown in FIG. 5, largest-diameter portions are situated inside the two ends, and $D_9=30$ mm, $D_{10}$, $D_{11}=30.25$ mm, and $D_{12}$, $D_{13}=29.4$ mm, in pressure contact with each other.

In the experiments, each fixing roller was combined with pressing rollers having different hardness values, and the degree of "corrugation" produced at two end portions of a transfer material, and the mountability of sheets of the transfer material in a face-down sheet-discharging operation were evaluated. Table 1 shows the results of the experiments using the conventional fixing device. In Table 1, mark ∘ indicates "excellent", mark Δ indicates "practically no problem", and mark x indicates "inferior".

TABLE 1

| Hardness of pressing roller | 30° | 40° | 50° | 60° | 70° | 80° |
|---|---|---|---|---|---|---|
| Corrugation | x | x | x | x | Δ | ∘ |
| Mountability | ∘ | ∘ | ∘ | ∘ | x | x |

Table 1 indicates that when the hardness of the pressing roller is low, the effect of improving the shape of end portions of the pressing roller is canceled, causing remarkable "corrugation". When the hardness of the pressing roller is high, a large amount of pressure and heat are supplied to two end portions of the transfer material, whereby fibers of the tranfer material are greatly stretched, inverse curl occurs in the transfer material, and therefore the mountability of sheets of the transfer material is degraded. It has become clear that when the conventional heating fixing device is used, it is difficult to prevent "corrugation" and at the same time to provide excellent mountability of sheets of the transfer material.

Table 2 shows experimental results obtained when the heating fixing device of the present embodiment is used.

TABLE 2

| Hardness of pressing roller | 30° | 40° | 50° | 60° | 70° | 80° |
|---|---|---|---|---|---|---|
| Corrugation | o | o | o | o | o | o |
| Mountability | o | o | o | o | o | o |
| Stripes | o | o | o | o | Δ | x |

Table 2 indicates that even if the hardness of the pressing roller is low, the occurrence of "corrugation" at two end portions of the transfer material can be prevented by providing the transfer material with appropriate stiffness. On the other hand, even if the hardness of the pressing roller is high, a large amount of pressure and heat are not supplied to two end portions of the transfer material, and the mountability of sheets of the transfer material can be improved. However, when the hardness of the pressing roller is high, stripes caused by the shape of the ends of the fixing roller are remarkably produced in the vicinity of two end portions of the transfer material, thereby degrading the quality of the obtained image. In order to prevent "corrugation" and at the same time to provide excellent mountability of sheets of the transfer material, and to prevent the occurrence of strips, it is effective to make the hardness of the pressing roller to be equal to or less than 70°, and more preferably, to be equal to or less than 60°, in addition to improving the shape of the ends of the fixing roller as in the present embodiment. In the present embodiment, tension is applied to the recording material by the hard fixing roller which is resistant to deformation. Hence, the recording material can be securely regulated.

In the present embodiment, the pressing roller 10 has an inverse-crown shape in which the outer diameter at the center in the longitudinal direction has a smaller value, and the outer diameter at the two ends has a largest value. If the pressing roller 10 has a crown shape in which the outer diameter at the two ends in the longitudinal direction has a smallest value, and the outer diameter at the center has a largest value, the transfer material conforms to the shape of the fixing roller and the like when it passes through a nip portion formed by the fixing roller and the pressing roller, so that inverse curl increases, and the mountability of sheets of the transfer material is extremely degraded. In addition, a large force exerted toward the center of the transfer material in the longitudinal direction is present. Hence, particularly in a flexible transfer material, such as thin paper, or paper absorbing moisture while being held in a very humid environment, creases are to be produced in the vicinity of the center of the transfer material in the longitudinal direction. In order to prevent such creases, the pressing roller preferably has a straight shape or an inverse-crown shape. Particularly when a fixing roller having the shape of the ends as shown in the present embodiment is used, the function of stretching fibers on the side of a non-printed surface of the transfer material at two end portions caused by the above-described shape contributes to prevent inverse curl. Furthermore, by using the above-described pressing roller having a straight shape or an inverse-crown shape, rigidity can be efficiently provided to two end portions of the transfer material, so that it is possible to obtain the effect of preventing creases, and to widen the range of the shape of end portions of the fixing roller which can be used.

Figure 6:
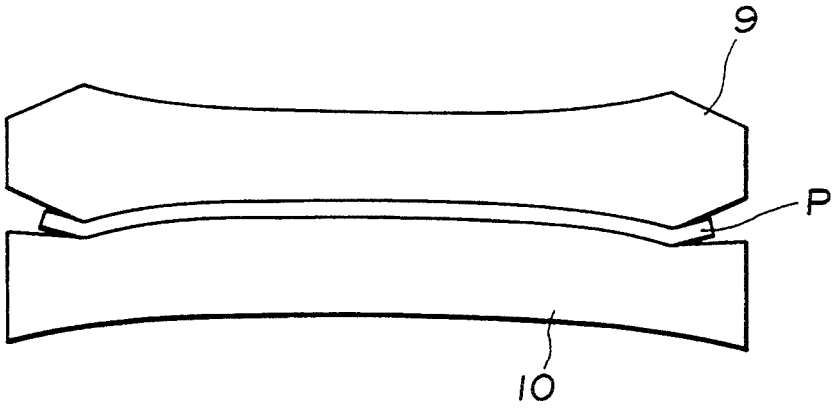
FIG. 6 is a diagram illustrating a pressing state provided by the fixing roller and a pressing roller of the first embodiment.

It has been described that the pressing roller preferably has a straight shape or an inverse-crown shape. However, in order to obtain the effect of the present invention, it is preferred that the pressing roller has a portion which has substantially an inverse-crown shape in a state of pressure contact with the fixing roller, as shown in FIG. 6. For example, in the pressing roller shown in the present embodiment, its two end portions are bent about 0.2 mm in a pressed state. Experiment performed in such a state have shown that the above-described effect can be sufficiently obtained if the difference ΔR between the outer diameter of the pressing roller at the central portion in the longitudinal direction and the outer diameter at two end portions is equal to or less than 0.2 mm. If this conclusion is expressed in a general expression, it is preferred that the difference ΔR between the outer diameter of the pressing roller at the central portion in the longitudinal direction and the outer diameter at the two end portions satisfies the following expression:

$$\Delta R \leqq 2 \times 5wl^4/6\pi Ed^4,$$

where w is the load per unit length, l is the length of the core bar, E is Young's modulus, and d is the outer diameter of the core bar.

By configuring the heating fixing device as in the present embodiment, it is possible to totally prevent problems, such as "corrugation", stripes, inverse curl and creases, which will occur in the transfer material, and to remarkably improve the quality of the obtained image, for example, without performing large-scale improvement in the apparatus, increasing the production cost of the apparatus, and degrading the productivity of the apparatus.

Figure 7:
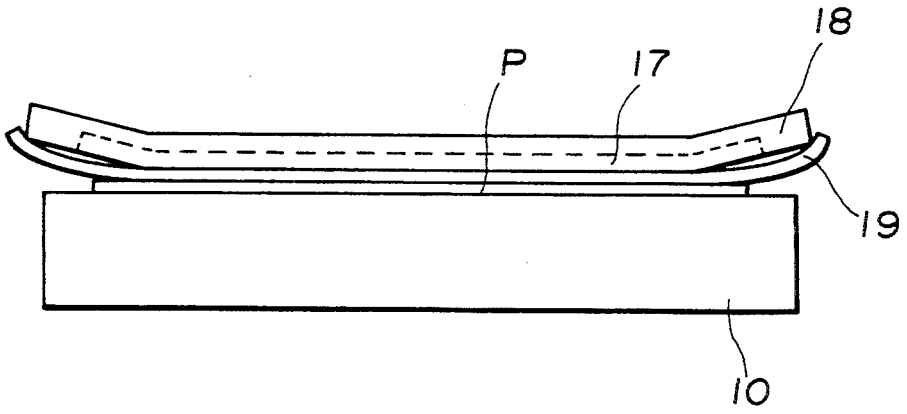
FIG. 7 is a diagram illustrating the configuration of a heating fixing device according to a modification of the first embodiment.

Although in the present embodiment, a description has been provided illustrating a rotating member including a halogen-lamp heater as a heating member, the present invention may, of course, be applied to a heating fixing device having the schematic configuration shown in FIG. 7, in which a fixed member 18 incorporating a heating member 17 is used as a heating member, a heat-resistant film 19 is conveyed between the fixed member 18 and a pressing member 10, and heat generated by the heating member 17 is supplied to a transfer material P via the heat-resistant film 19.

Second Embodiment

Figure 8:
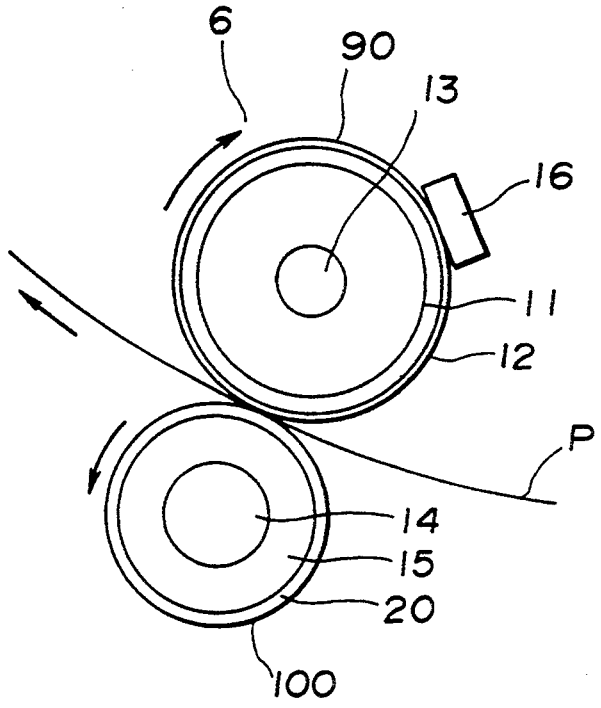
FIG. 8 is a diagram illustrating the configuration of a heating fixing device according to a second embodiment of the present invention.

A second embodiment of the present invention will now be described. FIG. 8 illustrates a heating fixing apparatus 6 used in the present embodiment. In FIG. 8, the same components as those shown in FIG. 1 are indicated by the same reference numerals, and a description thereof will be omitted. The present embodiment has a feature in that a fixing roller 90 is combined with a pressing roller 100 having a PFA film 30 μm thick coated on the surface layer of silicone rubber 15. The provision of a releasing layer such as the above-described PFA film on the surface of the presing roller is very important from the viewpoint of preventing adhesion of toner particles, paper powders and the like to the surface of the pressing roller as contamination, and increasing the life of the pressing roller without using a cleaning member.

The effects of the present embodiment will be shown illustrating results of comparative experiments performed using a conventional heating fixing device. The configuration of the conventional heating fixing device, the method of experiments, and the criteria of evaluation are the same as in the first embodiment.

First, table 3 illustrates experimental results obtained when the fixing roller is combined with a pressing roller having no releasing layer, and a pressing roller having a releasing layer in the conventional heating fixing device.

TABLE 3

| Hardness of pressing roller | | 20° | 30° | 40° | 50° | 60° | 70° | 80° |
|---|---|---|---|---|---|---|---|---|
| Releasing layer absent | Corrugation | x | x | x | x | x | Δ | ○ |
| | Mountability | ○ | ○ | ○ | ○ | Δ | x | x |
| Releasing layer present | Corrugation | x | x | x | x | x | x | x |
| | Mountability | ○ | ○ | ○ | ○ | Δ | x | x |

Table 3 indicates that when the pressing roller has the releasing layer on its surface, "corrugation" is produced on two end portions of the transfer material irrespective of the hardness of the pressing roller. The reason is considered as follows. That is, since each of the fixing roller and the pressing roller has a releasing layer having an excellent slidability on its surface, the transfer material present between these layers slips, thereby degrading the effect of providing rigidity to two end portions of the transfer material.

Table 4 illustrates experimental results obtained when the heating fixing device including the fixing roller of the present invention is combined with a pressing roller not having a releasing layer, and a pressing roller having a releasing layer.

TABLE 4

| Hardness of pressing roller | | 20° | 30° | 40° | 50° | 60° | 70° | 80° |
|---|---|---|---|---|---|---|---|---|
| Releasing layer absent | Corrugation | Δ | ○ | ○ | ○ | ○ | ○ | ○ |
| | Mountability | ○ | ○ | ○ | ○ | ○ | ○ | ○ |
| Releasing layer present | Corrugation | x | Δ | ○ | ○ | ○ | ○ | ○ |
| | Mountability | ○ | ○ | ○ | ○ | ○ | ○ | ○ |

Table 4 incidates that in order to increase the life of the pressing roller by providing a releasing layer on the surface thereof, to prevent the occurrence of "corrugation" at two end portions of the transfer material by providing the transfer material with appropriate stiffness, and to improve the mountability of sheets of the transfer material without providing the two end portions of the transfer material with excessive pressure and heat, it is effective to improve the shape of end portions of the fixing roller as in the present invention, and to make the hardness of the pressing roller to be at least 30°, and more preferably, at least 40°. In addition, as shown in the first embodiment, in order to prevent the occurrence of stripes in the vicinity of two end portions of the transfer material caused by the shape of end portions of the fixing roller, it is effective to make the hardness of the pressing roller to be equal to or less than 70°, and more preferably, equal to or less than 60°.

Although in the present embodiment, a description has been provided illustrating a rotating member including a halogen-lamp heater as a heating member, the present invention may, of course, be applied to a heating fixing device having the schematic configuration shown in FIG. 7, in which a fixed member 18 incorporating a heating member 17 is used as a heating member, a heat-resistant film 19 is conveyed between the fixed member 18 and a pressing member 10, and heat generated by the heating member 17 is supplied to a transfer material P via the heat-resistant film 19.

Third Embodiment

A third embodiment of the present invention will now be described. The present embodiment has a feature in that a fixing roller having a diameter smaller than that of the fixing roller used in the first embodiment is used. More specifically, the outer diameter $D_1$ at the smaller-diameter portion is 20 mm, the outer diameters $D_2$ and $D_3$ at the largest-diameter portions "a" equal 20.28 mm, and the outer diameters $D_4$ and $D_5$ at the two ends b equal 19.4 mm. The positional relationship between the largest-diameter portion "a", the two ends b, and the positions c where two end portions of the transfer material P pass is the same as in the first embodiment.

The effects of the present embodiment will be shown illustrating results of comparative experiments performed using a conventional heating fixing device. The configuration of the conventional heating fixing device, the method of experiments, and the criteria of evaluation are the same as in the first embodiment.

First, table 5 illustrates experimental results obtained in the heating fixing device in which conventional fixing rollers having different outer diameters are combined with a pressing roller having a releasing layer on the surface thereof.

TABLE 5

| Outer diameter of fixing roller | 20 mm | 25 mm | 30 mm | 35 mm | 40 mm | 50 mm |
|---|---|---|---|---|---|---|
| Mountability | x | x | x | Δ | Δ | ○ |

Table 5 indicates that as the outer diameter of the fixing roller is reduced, the mechanical strength of the fixing roller is reduced, whereby the fixing roller is bent in the shape of a bow in pressure contact with the pressing roller. As a result, excessive pressure and heat are supplied to two end portions of the transfer material, whereby fibers of the transfer material are stretched to produce inverse curl in the transfer material. Hence, the mountability of sheets of the transfer material is deteriorated.

Table 6 illustrates experimental results obtained when fixing rollers having different outer diameters of the present embodiment are combined with a pressing roller having a releasing layer on the surface thereof.

TABLE 6

| Outer diameter of fixing roller | 20 mm | 25 mm | 30 mm | 35 mm | 40 mm | 50 mm |
|---|---|---|---|---|---|---|
| Mountability | Δ | Δ | ○ | ○ | ○ | ○ |

Table 6 indicates that by increasing the thickness of the fixing roller in order to obtain sufficient mechanical strength when reducing the diameter of the fixing roller, there is no problem of providing a large amount of electric power consumption. Hence, even when the outer diameter of the fixing roller is small, the mountability of sheets of the transfer material can be improved without providing two end portions of the transfer material with excessive pressure and heat. In an image forming apparatus, such as a printer for a personal computer, it is important to suppress electric power consumption to a lowest level possible. In general, 600 W is considered to be an upper limit for the electric power. Under such circumstances, in order to reduce the waiting time so that the user will not feel inconvenience, the outer diameter of the fixing roller is preferably equal to or less than 30 mm. In such a case, in order to prevent "corrugation" and at the same time to provide excellent mountability of sheets of the tranfer material, it is effective to improve the shape of end portions of the fixing roller as in the present embodiment.

Next, a description will be provided mainly of embodiments of the present invention in which corrugation of end portions of the recording material is more strictly prevented.

Fourth Embodiment

Figure 9:
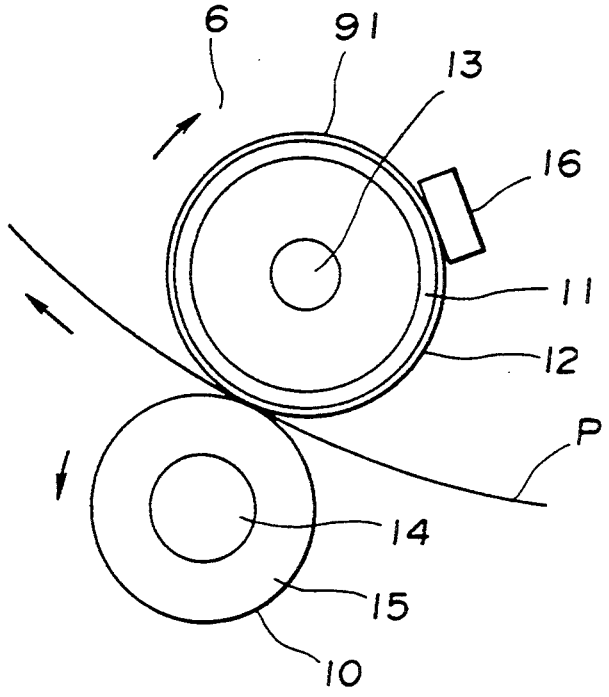
FIG. 9 is a diagram illustrating the schematic configuration of a heating fixing device according a fourth embodiment of the present invention.

FIG. 9 illustrates the configuration of a heating fixing device 6 according to a fourth embodiment of the present invention. In FIG. 9, there are shown a fixing roller 91 and a pressing roller 10, which rotate in the directions of the respective arrows. In the present embodiment, the maximum size of the recording material which can be passed is the LTR size (216 mm wide and 279 mm long). The fixing roller 91 comprises a PFA layer 12 30 μm thick coated on the surface of a hollow cor bar 11, made of aluminum having excellent heat resistance, having a thickness of 3 mm and an inner diameter of 24 mm. A halogen-lamp heater 13 for heating the fixing roller 91 is disposed inside the hollow core bar 11. The pressing roller 10 comprises silicone rubber 15, having excellent releasability and a thickness of 10 mm, formed on the outer circumference of a core bar 14, made of iron, having an outer diameter of 10 mm. The hardness of the pressing roller 10 is 50° (ASKER-C hardness with a load of 500 gf).

The fixing roller 91 and the pressing roller 10 are in pressure contact with each other by springs (not shown) at respective two end portions in the longitudinal direction. A thermistor 16 for detecting the surface temperature of the fixing roller 91 contacts the fixing roller 91. Information relating to the surface temperature of the fixing roller 91 detected by the thermistor 16 is transmitted to a CPU (not shown) via an A/D converter (not shown). The CPU performs on-off control of the halogen-lamp heater 13 via an AC driver (not shown), so that the surface temperature of the fixing roller 91 is controlled at a predetermined value.

The shape of the fixing roller 91 included in the heating fixing device of the present embodiment will now be described in detail with reference to FIG. 10.

In order to prevent the occurrence of creases in the transfer material P, the fixing roller 91 has an inverse-crown shape, in which the outer diameter at a central portion in the longitudinal direction is smaller than the outer diameter at largest-diameter portions, within a region where the recording material passes, and the largest-diameter portions are situated inside the two ends in the longitudinal direction within the region where the recording material passes, and the outer diameter is gradually reduced toward the two ends. In the present embodiment, the outer diameter $D_1$ at the center within the region where the recording material passes is 30 mm, the outer diameters $D_2$ and $D_3$ at the largest-diameter portions "a" equal 30.1 mm, and the outer diameters $D_4$ and $D_5$ at the two ends b equal 29.8 mm. Corrugation produced at end portions of the recording material was evaluated. The largest-diameter portions "a" are inside positions c where the two ends of the transfer material P pass. The distance L between "a" and c is 4 mm. The positions c where the two ends of the transfer material P pass are inside the two ends b of the fixing roller 91. The distance L' between b and c is 6 mm.

Figure 11:
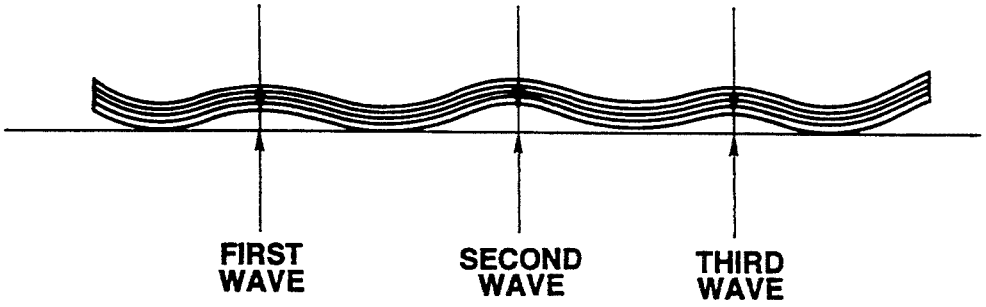
FIG. 11 is a diagram illustrating a state in which end portions of sheets of a recording material are corrugated.

As shown in FIG. 11, 50 output sheets of the recording material were superposed in the shape of a flat plate, and the number of observed waves of corrugation produced at an end portion of the recording material was counted. The result of the count indicates that when the heating fixing device of the present embodiment was used, the number of waves was equal to or less than two, and the height of the corrugation is equal to or less than 1 mm, so that the sheets were observed to be substantially straight as viewed from a laterial side. The occurrence of creases in the recording material and problems in the obtained image were not parctically present.

On the other hand, when the above-described conventional fixing roller only having an inverse-crown shape was used, and when the outer diameters at end portions of the fixing roller were reduced only to the degree described in Japanese Patent Laid-open Application (Kokai) No. 2-262684 (1990), the above-described effects were insufficient.

Table 7 illustrates experimental results obtained when corrugation produced at end portions of the recording material was evaluated while changing the outer diameters $D_4$ and $D_5$ at the two ends b. As for the evaluation of the corrugation, the number of waves, observed when 50 output sheets of the recording material were superposed in the state of a flat plate as shown in FIG. 11, was counted.

TABLE 7

| Outer diameter ($D_4$ and $D_5$) | 30.10 | 30.00 | 29.95 | 29.90 | 29.80 | 29.60 | 29.40 |
|---|---|---|---|---|---|---|---|
| Number of waves | 5 | 4 | 4 | 3 | 2 | 2 | 2 |

Results of panel tests by a plurality of subjects indicate that the number of waves with which the subjects do not feel awkward when output sheets are superposed is equal to or less than three, and more preferably, equal to or less than two . Hence, the outer diameters $D_4$ and $D_5$ are preferably equal to or less than 29.90, and more preferably, equal to or less than 29.80. It can be considered from these results that the inclination of the outer diameter decreasing from the largest-diameter portions "a" toward the two ends of the fixing roller 91 in a tapered shape is an important factor in order to prevent corrugation at end portions of the recording material. Accordingly, the inclination of the tapered shape of the outer diameter is preferably at least (30.10−29.90) mm/10 mm=0.02, and more preferably, at least (30.10−29.80) mm/10 mm=0.03.

The upper limit of the above-described inclination is determined in consideration of the possibility of the occurrence of vertical stripes caused by the recording material strongly bent along the shape of the fixing roller at the nip portion. The present inventors checked vertical stripes produced in the obtained image at positions corresponding to the largest-diameter portions "a" when an entirely black image was output in a weight condition of 75 g/m$^2$, and obtained expermental results as shown in table 8.

TABLE 8

| Inclination of tapered portion | 0.05 | 0.07 | 0.1 | 0.15 | 0.2 | 0.25 | 0.3 |
|---|---|---|---|---|---|---|---|
| Vertical stripes | ○ | ○ | ○ | ○ | Δ | x | x |

In table 8, mark ○ represents a state of no vertical stripes, mark Δ represents a state in which vertical stripes can be observed but there is no practical problem, and mark x represents a state in which vertical stripes can be clearly observed. The above-described results indicate that the inclination of the tapered portion is preferably equal to or less than 0.2, and more preferably, equal to or less than 0.15.

As described above, it becomes clear that in order to more securely prevent corrugation at end portions of the recording material, the fixing roller must have a tapered shape such that the outer diameter is sequentially reduced from positions inside the positions corresponding to the ends of the recording material toward the outsides of the fixing roller within a range where the recording material passes, and the inclination of the outer diameter in that portion is preferably between 0.02 and 0.2, and more preferably, between 0.03 and 0.15.

Figure 12:
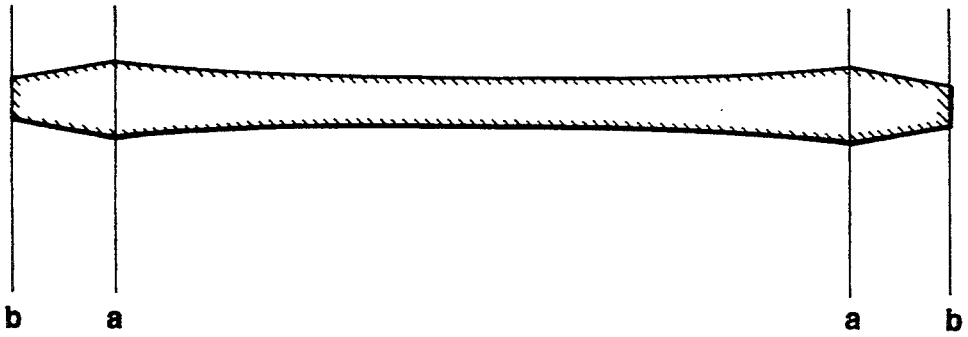
FIG. 12 is a diagram illustrating the shape of a nip formed in the device shown in FIG. 9.

The reasons of the above-described functions and effects are considered as follows. Wavelike corrugation is produced at end portions of the recording material by the following reason. That is, since the width of the nip at end portions of the recording material is greater than that of other portions, a strong stress is applied to the end portions of the recording material, and the end portions are conveyed at a speed greater than that of other portions, thereby causing slip at the end portions of the recording material within the nip region. On the other hand, in the heating fixing device of the present embodiment, the nip formed by the fixing roller and the pressing roller has a shape as shown in FIG. 12, so that the width of the nip is gradually reduced at regions outside the largest-diameter portions "a". As a result, the stress applied to the end portions of the recording material is reduced, and the positions where the slip occurs within the nip region shift to portions inside the end portions of the recording material. Hence, the end portions of the recording material can always be conveyed while contacting the fixing roller, whereby corrugation, which will be produced by a part of the recording material being stretched by a shock during the slip, hardly occurs. Accordingly, it can be said that the range of numerical values of the inclination of the outer diameter at end portions of the fixing roller shown in the present embodiment is preferable in order to form the above-described shape of the nip.

Fifth Embodiment

Next, a fifth embodiment of the present invention will be described with reference to FIG. 13.

Figure 13:
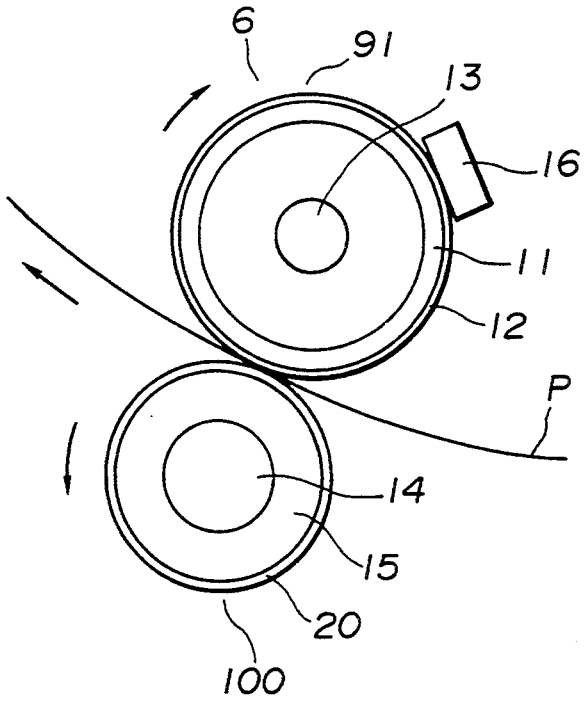
FIG. 13 is a diagram illustrating the schematic configuration of a heating fixing device according a fifth embodiment of the present invention.

FIG. 13 illustrates a heating fixing apparatus 8 used in the present embodiment. The present embodiment has a feature in that a fixing roller 91 is combined with a pressing roller 100 having a PFA film 50 μm thick coated on the surface of silicone rubber 15.

The provision of a releasing layer such as the above-described PFA film on the surface of the pressing roller is very important from the viewpoint of preventing adhesion of toner particles, paper powders, and the like to the surface of the pressing roller as contamination, and increasing the life of the pressing roller without using a cleaning member. When a releasing layer, such as a PFA tube, or the like, is provided on the surface of the pressing roller, the recording material is apt to slip relative to the fixing roller and the pressing roller, a movement of the recording material in a direction perpendicular to the conveying direction of the recording material is apt to be produced due to differences in the circumferential speed caused by the shape of the outer diameter of the fixing roller, corrugation at end portions of the recoring material is apt to be produced, and vertical stripes in the obtained image described in the fourth embodiment are apt to be produced.

As a result of investigation on the above-described problems made by the present inventors it has become clear that in addition to optimizing the inclination of the shape of the outer diameter of the fixing roller at positions corresponding to the ends of the recording material, the relationship between the inclination of the shape of the outer diameter at end portions and the inclination of the shape of the outer diameter at a portion having an inverse-crown shape must be appropriately arranged.

The heating fixing device 6 shown in FIG. 13 has the same configuration as that of the fourth embodiment, except that the above-described PFA tube 20 50 μm thick is provided on the surface of the pressing roller, which comprises the silicone-rubber layer 15 10 mm thick formed on a core bar 14, made of iron, having an outer diameter of 10 mm. Hence, a description thereof will be omitted.

Figure 10:
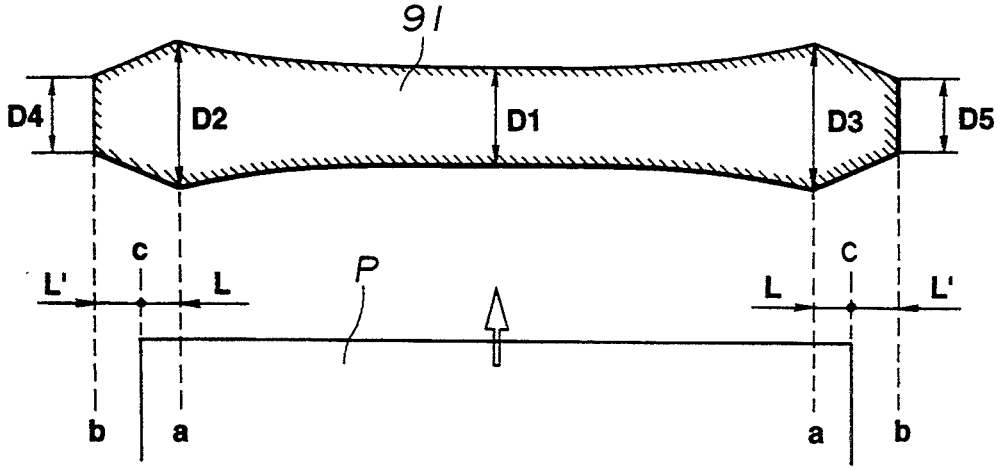
FIG. 10 is a diagram illustrating the shape of a fixing roller of the heating fixing device shown in FIG. 9.

In the present embodiment, the fixing roller 91 shown in FIG. 10 is used, and experiments on corrugation and vertical black stripes in the obtained image were performed taking the amount of the inverse-crown shape ($D_2-D_1$ or $D_3-D_1$), and the inclination of the outer diameter at tapered end portions ($(D_2-D_4)/(L+L')$ or $(D_3-D_5)/(L+L')$) as parameters.

Table 9 illustrates the results of the above-described experiments relating to corrugation at end portions of the recording material, and Table 10 illustrates the results relating to vertical black stripes in the obtained image.

TABLE 9

| Inclination at end portions | | 0.01 | 0.02 | 0.03 | 0.05 | 0.1 | 0.15 | 0.3 |
|---|---|---|---|---|---|---|---|---|
| Amount of inverse-crown shape | 0.05 | x | ○ | ○ | ○ | ○ | x | x |
| | 0.1 | x | ○ | ○ | ○ | ○ | ○ | x |
| | 0.2 | x | x | x | ○ | ○ | ○ | ○ |

Table 9 indicates that in order to prevent corrugation at end portions of the recording material, the inclination of tapered end portions of the fixing roller preferably has a value greater than the amount of the inverse-crown shape of the fixing roller by at least a predetermined value, in addition that the inclination must be at least 0.02 as described in the fourth embodiment. If the amount of the inverse-crown shape of the fixing roller is represented by inclination as the inclination of the tapered end portions, the amount of the inverse-crown shape of 0.05 mm is represented by 0.0005 (0.05 mm/104 mm), the amount of the inverse-crown shape of 0.1 mm is represented by 0.001, and the amount of the inverse-crown shape of 0.2 mm is represented by 0.002. Accordingly, it can be understood from the results shown in Table 9 that in order to prevent corrugation at end portions of the recording material, the ratio of the inclination at tapered end portions to the inclination of the amount of the inverse-crown shape preferably equals at least 20. This is because a force to stretch the recording material toward end portions is strongly exerted due to the inverse-crown shape of the fixing roller, and a force to draw the recording material toward a central portion is exerted at end portions of the recording material. At that time, if the force to stretch the recording material toward end portions is strong due to the inverse-crown shape, slip tends to occur at the largest-diameter portion "a". Since the surface of the pressing roller is very slidable, the slip force is exerted even toward end portions of the recording material. If the inclination of tapered end portions is large, a force to cancel the slip force is exerted. If the inclination of tapered end portions is small, the slip force is not weakened, and slip also occurs at end portions of the recording material, thereby causing corrugation. If the amount of the inverse-crown shape is small, and if the inclination of tapered end portions is too large, the force to draw the recording material toward a central portion is too strong to produce a slip force, thereby causing corrugation. If this is expressed by the ratio of the inclination of tapered end portions to the inclination of the inverse-crown shape as in the above-described manner, it can be understood that the ratio is preferably less than 300.

Table 10 illustrates experimental results obtained for vertical stripes in the obtained image, which is another factor for determining the upper limit of the ratio of the inclination of tapered end portions to the inclination of the inverse-crown shape.

TABLE 10

| Inclination at end portions | | 0.05 | 0.07 | 0.1 | 0.15 | 0.2 | 0.25 | 0.3 |
|---|---|---|---|---|---|---|---|---|
| Amount of inverse-crown shape | 0.05 | ∘ | ∘ | ∘ | ∘ | Δ | x | x |
| | 0.1 | ∘ | ∘ | ∘ | ∘ | Δ | x | x |
| | 0.2 | ∘ | ∘ | ∘ | ∘ | Δ | x | x |

Table 10 indicates that as in the fourth embodiment, vertical stripes in the obtained image are not related to the amount of the inverse-crown shape, and are determined by the value of the inclination of tapered end portions. It can be considered that this is because this phenomenon is only caused by a force to bend the recording material due to the shape of the outer diameter of the fixing roller. Accordingly, when a very slidable releasing layer, such as a PFA tube, is provided on the pressing roller as in the present embodiment, it can be understood that the ratio of the inclination of end portions of the fixing roller to the inclination of the inverse-crown shape formed from a central portion to end portions of the fixing roller is more preferably in the range of 20–300, in addition that the inclination of end portions of the fixing roller is preferably between 0.02 and 0.2 as in the fourth embodiment.

Although in the present embodiment, a description has been provided of a heating fixing apparatus including a pressing roller having a releasing layer made of PFA or the like, the range of the numerical values of the present embodiment is, of course, effective even if the above-described releasing layer is not provided.

Sixth Embodiment

Figure 14:
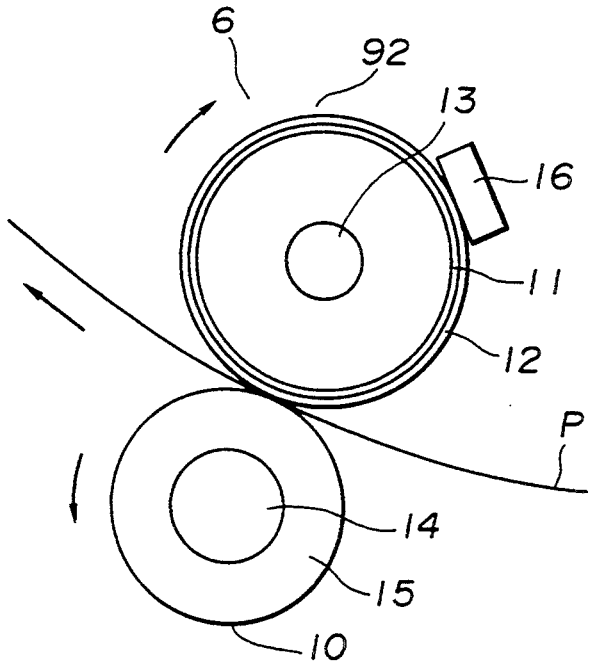
FIG. 14 is a diagram illustrating the schematic configuration of a heating fixing device according to a sixth embodiment of the present invention.

Next, a description will be provided of a sixth embodiment of the present invention with reference to FIGS. 14 and 15.

The present embodiment relates to a further improvement of the fourth embodiment, in which the range of numerical values for the inclination of tapered end portions of the fixing roller can be widened. More specifically, this is achieved by considering changes in the inclination of the tapered end portions in addition to the inclination of the tapered end portions.

FIG. 14 illustrates a heating fixing device 8 used in the present embodiment. The present embodiment has a feature in that the thickness of the core bar of a fixing roller 92 is made to be as thin as 2 mm or less. By thus reducing the thickness of the core bar of the fixing roller 92, the surface temperature of the fixing roller 92 quickly rises, so that the waiting time is reduced. Even if a power-saving mode, in which power supply to a fixing roller 13 is interrupted during a standby state, is adopted, the surface temperature of the fixing roller 92 quickly rises when resuming the power. Accordingly, the supply of power-saving mode can be frequently adopted, so that the present embodiment is effective for saving energy. However, when such a thin fixing roller 92 is used, the amount of taper of the fixing roller from positions corresponding to the ends of the recording material is limited by the strength of the core bar. As a result of investigation made by the inventors of the present application, it has become clear that by optimizing the rate of change of the inclination of the outer diameter of end portions of the fixing roller in addition to optimizing the inclination, an excellent effect of preventing corrugation at end portions of the recording material is obtained even for a fixing roller having a thin core bar in which the inclination of end portions cannot be sufficiently increased.

Figure 15A:
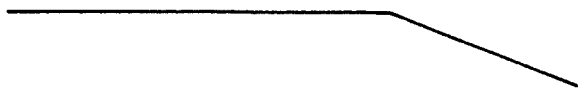
FIG. 15*a*, 15*b* and 15*c* is a fragmentary enlarged view illustrating the shape of a fixing roller shown in FIG. 14.
Figure 15B:
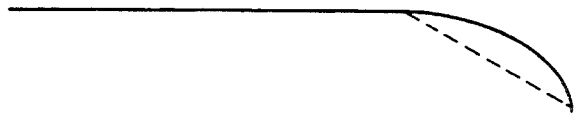
Figure 15C:
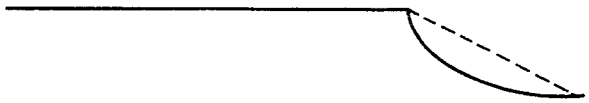

FIG. 15 is a fragmentary enlarged view illustrating the shape of a tapered end portion of each of three fixing rollers according to of the present embodiment. In the present embodiment, the thickness of the core bar is 1.5 mm. FIG. 15*a* illustrates a fixing roller whose outer diameter is linearly reduced from a largest-diameter portion toward an end portion (roller a). FIG. 15*b* illustrates the shape of an outer diameter having a convex circular shape, in which the inclination gradually increases from a portion where taper starts toward an end portion (roller b). FIG. 15*c* illustrates the shape of an outer diameter having a concave Circular shape, in which the inclination gradually decreases from a portion where taper starts toward an end portion (roller c). Table 11 illustrates results of evaluation of corrugation at end portions of the recording material by changing the amount of taper of each of the above-described fixing rollers.

TABLE 11

| Inclination at end portions Roller | 0.01 | 0.015 | 0.02 | 0.025 | 0.03 | 0.04 | 0.05 |
|---|---|---|---|---|---|---|---|
| a | x | Δ | Δ | ∘ | ∘ | ◎ | ◎ |
| b | x | Δ | ∘ | ∘ | ∘ | ◎ | ◎ |
| c | x | x | Δ | Δ | ∘ | ∘ | ∘ |

In table 11, mark x represents a state in which the number of waves equals at least four, mark Δ represents a state in which the number of waves equals three, mark ∘ represents a state in which the number of waves equals two, and mark ◎ represents a state in which the number of waves is equal to or less than one. The results shown in table 11 indicate that there is no practical problem if the inclination of tapered end portions equals at least 0.02 irrespective of the shape of tapered end portions. However, if it is intended to further reduce corrugation at end portions of the recording material, the shapes "a" and b are superior, and the shape of tapered end portions of the fixing roller becomes a very important factor. Particularly when, for example, a thin fixing roller is used, since it is desired to reduce the amount of taper as much as possible from the viewpoint of the strength of the core bar, it can be understood that the shape "a" or b is effective. The reason why the shapes "a" and b are superior to the shape c can be considered that the pressing roller and the recording material can easily conform to the shape of tapered end portions of the fixing roller, so that the degree of close contact with the fixing roller is improved, and slip, which will cause corrugation at end portions of the recording material, is not produced. Accordingly, it is preferred that the inclination of tapered end portions of the fixing roller is constant from a portion where taper starts to the ends of the fixing roller, or that the inclination is small at a portion where taper starts and thereafter gradually increases.

Furthermore, by adopting the shape "a or "b" for tapered end portions of the fixing roller as in the present embodiment, another effect can be obtained such that stripes, which have been apt to occur at the tapered end portions, hardly occur even in thick paper or OHP paper.

Seventh Embodiment

Next, a seventh embodiment of the present invention will be described with reference to FIG. 16.

Figure 16:
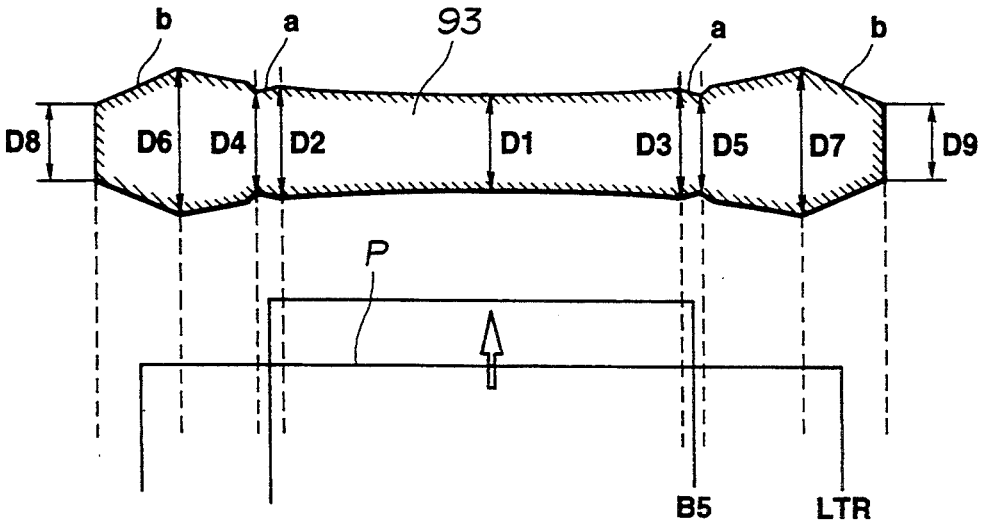
FIG. 16 is a diagram illustrating the shape of a fixing roller according to a seventh embodiment of the present invention.

FIG. 16 is a diagram illustrating the schematic configuration of the shape of the outer diameter of a fixing roller used in a heating fixing device according to the seventh embodiment. A fixing roller 93 of the present embodiment is used in a heating fixing device having the same cross-sectional shape as that shown in FIG. 9. Hence, a description of the heating fixing device will be omitted.

The present embodiment relates to a technique to prevent corrugation at end portions of a recording material for a plurality of sizes of recording materials. As shown in FIG. 16, the fixing roller has an inverse-crown shape in which the outer diameter gradually increases from the center toward end portions. At portions of the fixing roller corresponding to the ends of each size of recording material, the outer diameter of the fixing roller is reduced toward the outside in a tapered shape. In the present embodiment, each of a portion "a" corresponding to the B5 size (177 mm× 248 mm) and the EXE size (184 mm×267 mm), and a portion b corresponding to the A4 size (210 mm×297 mm) and the LTR size (216 mm×279 mm) has a tapered shape. More specifically, the outer diameter $D_1$ at the center is 30.0 mm. The outer diameter then gradually increases toward end portions. In the portion "a" corresponding to the B5 size and the EXE size, the outer diameter has the largest value $D_2$ ($D_3$)=30.07 mm at a position 85 mm from the center. A partial tapered shape starts from that position, and the outer diameter at a position 95 mm from the center equals $D_4$ ($D_5$)=29.87 mm. The outer diameter then gradually increases toward end portions, and has the largest value $D_6$ ($D_7$)=30.15 mm at a position 102 mm from the center. An increasing tapered shape starts from that position, and the outer diameter at a position 112 mm from the center equals $D_8$ ($D_9$)=29.75 mm.

When the above-described fixing roller was used, in all sizes from the B5 size to the LTR size, corrugation at end portions of the recording material could be effectively prevented without causing problems, such as creases, vertical stripes in the obtained image, and the like. According to investigation made by the present inventors the numerical values described in the fourth through sixth embodiments can be applied to the tapered shape in the present embodiment without modification. Although in the present embodiment, the fixing roller has an inverse-crown shape in which the outer diameter gradually increases from the center toward end portions, the above-described effects may also be obtained by using a fixing roller having a straight shape in which the outer diameter is constant from the center toward end portions, forming the above-described tapered shapes corresponding to the respective sizes of recording materials, and adopting an inverse-crown shape for the pressing roller.

Eighth Embodiment

Next, an eighth embodiment of the present invention will be described with reference to FIG. 17.

Figure 17:
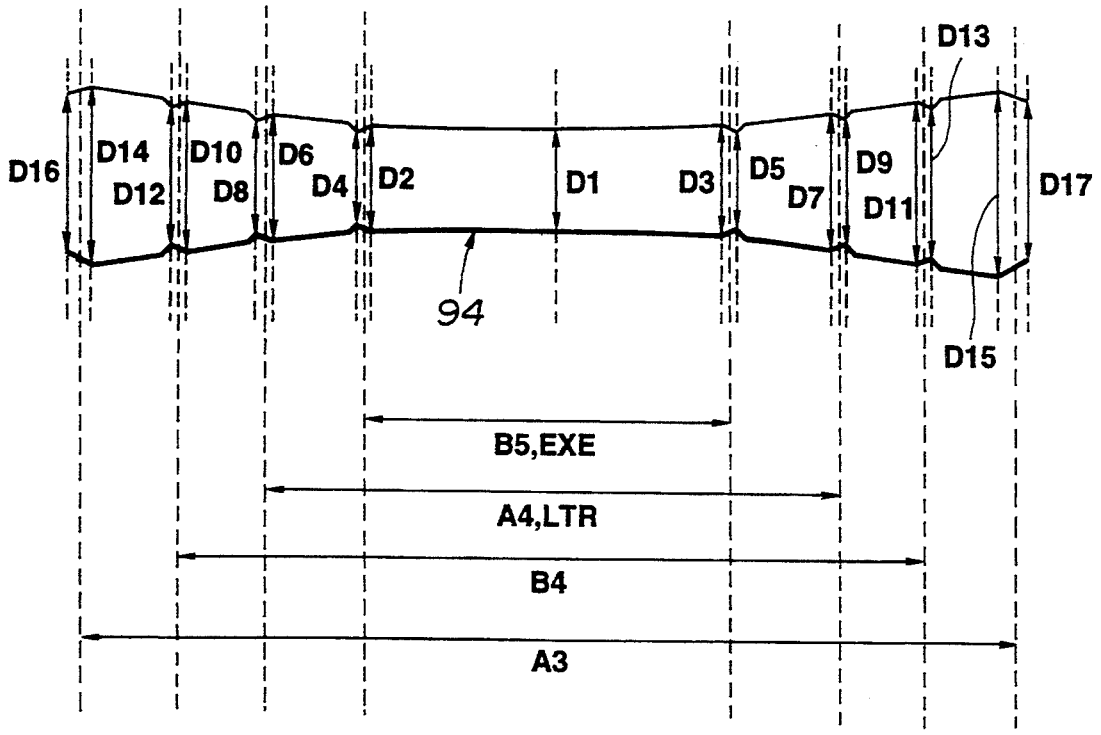
FIG. 17 is a diagram illustrating the shape of a fixing roller according to an eighth embodiment of the present invention.

FIG. 17 is a diagram illustrating the shape of the outer diameter of a fixing roller 94 used in a heating fixing device according to an eighth embodiment of the present invention. The heating fixing device which uses the fixing roller 94 has the same cross section as that shown in FIG. 9. The present embodiment relates to a technique to prevent corrugation at end portions of each recording material for a plurality of sizes of recording materials. In particular, the present embodiment is applied to wide recording materials, such as the A3 size (297 mm×420 mm), and the like, and is particularly effective when a releasing layer, made of PFA or the like, is provided on the surface of a pressing roller. More specifically, the present embodiment has a feature in that the inclination of a partial tapered portion of the fixing roller corresponding to each size of recording material increases as the width of the size increases.

In the case of using a wide recording material, such as the A3 size, if a nonuniform force is applied in the direction of the width of the recording material, the recording material is apt to be corrugated because the stiffness of the recording material in the direction of the width is weak. Particularly when an entirely black image is recorded, uneven density is apt to be produced in the entirely black image due to the corrugation. This tendency will become more pronounced particularly when a releasing layer, made of PFA or the like, is provided on the surface of the pressing roller, because the recording material slips in the nip region. Investigation made by the present inventors has shown that when partial tapered portions corresponding to respective sizes of recording materials are provided as described in the seventh embodiment, the above-described problems can be overcome by sequentially increasing the inclination of each tapered portion as that portion is closer to the end of the fixing roller. The functions and effects of the present embodiment will now be described illustrating specific examples and comparative examples.

In the fixing roller 94 shown in FIG. 17, the outer diameter at the center is $D_1$=30.0 mm, and the outer diameter has the largest value $D_2$ ($D_3$)=30.05 mm at a position 85 mm from the center within a portion corresponding to the B5 size and the EXE size. The outer diameter is then reduced in a tapered shape, and has a value of $D_4$ ($D_5$)=30.03 mm at a position 95 mm from the center. Within a portion corresponding to the A4 size and the LTR size (vertical feeding), the outer diameter has the largest value $D_6$ ($D_7$)=30.08 mm within the region where the recording material of the LTR size passes at a position 102 mm from the center. The outer diameter is then gradually reduced in a tapered shape, and has a value of $D_8$ ($D_9$)=30.04 mm at a position 112 mm from the center. Within a portion corresponding to the B4 size, the outer diameter has the largest value $D_{10}$ ($D_{11}$)=30.12 mm within the region where the recording material of the B4 size passes at a position 125 mm from the center. The outer diameter is then gradually reduced in a tapered shapes and has a value of $D_{12}$ ($D_{13}$)=30.06 mm at a position 132 mm from the center. In a portion corresponding to the A3 size, the outer diamter has the largest value $D_{14}$ ($D_{15}$)=30.15 mm within the region where the recording material of the A3 size passes at a position 145 mm from the center. The outer diameter is then gradually reduced in a tapered shape, and has a value of $D_{16}$ ($D_{17}$)=30.07 mm at a position 152 mm from the center. By using the above-described fixing roller 94, and a pressing roller having a straight shape and an outer diameter of 30.1 mm, comprising a PFA layer 50 μm thick coated on a silicone-rubber layer 10 mm thick formed on a core bar, made of iron, having an outer diameter of 10 mm, corrugation at end portions of each recording material could be effectively prevented without causing problems, such as creases, vertical stripes in the obtained image, uneven density in an entirely black image, and the like. In the present embodiment, the inclinations of respective tapered portions corresponding to respective sizes of recording materials sequentially increase from the center toward end portions of the fixing roller such as 0.02 (the portion corresponding to the B5 size and the EXE size), 0.04 (the portion corresponding to the A4 and the LTR size), 0.085 (the portion corresponding to the B4 size), and 0.115 (the portion corresponding to the A3 size). As a result, in the heating fixing device having the above-described configuration, particularly, it is possible to effectively prevent uneven density in an entirely black image. For the purpose of comparison, when the order of the inclination of the portion corresponding to the B5 size and the EXE size, and the inclination of the portion corresponding to the A size and the LTR size is inverted to be 0.03 and 0.02, respectively, uneven density due to corrugation in the recording material was produced in a central portion of the obtained image particularly when an entirely black image was recorded on the recording material of the A4 size. This is because the recording material slips by a tension, which increases toward end portions of the fixing roller due to the inverse-crown shape of the fixing roller, to stretch the recording material toward end portions of the recording material. In order to prevent the slip of the recording material by the tension, it is preferable to increase the inclination of each tapered portion as the portion is closer to the ends of the fixing roller so as to provide a force to balance the tension at each tapered portion.

As described above, when partial tapered portions are provided corresponding to respective sizes of recording materials, by sequentially increasing the inclination of each tapered portion as the width of the size of recording material increases, it is possible to more effectively prevent corrugation at end portions of the recording material without causing problems, such as creases, vertical stripes in the obtained image, uneven density in an entirely black image, and the like.

Ninth Embodiment

Next, a ninth embodiment of the present invention will be described with reference to FIG. 18.

Figure 18:
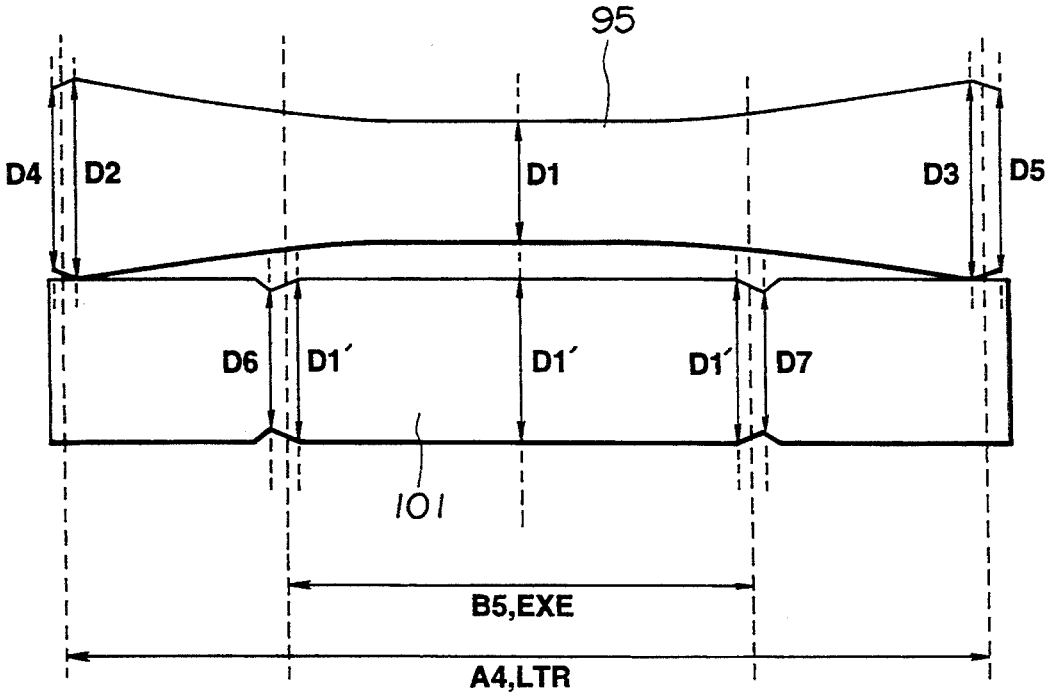
FIG. 18 is a diagram illustrating the configuration of a heating fixing device, as seen from the longitudinal direction, according to a ninth embodiment of the present invention.

FIG. 18 is a diagram illustrating the shapes of the outer diameters of a fixing roller 95 and a pressing roller 101 used in a heating fixing device according to the ninth embodiment. The present embodiment relates to a technique to prevent corrugation at end portions of a recording material for a plurality of sizes of recording materials, and has a feature in that a tapered portion is formed at the fixing roller 95 for the largest size of recording material, and partial tapered portions are formed at the pressing roller 101 for other smaller sizes of recording materials. When a recording material of the largest size is passed, the above-described partial tapered portions are present within the region of the obtained image. Accordingly, care must be taken so that the shapes of the partial tapered portions do not adversely influence the obtained image. When, for example, a fixing roller comprising a thin core bar having, for example, a thickness equal to or less than 2 mm is used, if a thin portion is partially present in the image region, the surface temperature of the fixing roller becomes too high at that portion, because thermal conduction of the fixing roller in a lateral direction is inferior. As a result, uneven density due to excessive fixing will be in some cases produced when, for example, an entire black image is fixed. In the present embodiment, it is possible to prevent corrugation even at end portions of a recording material having a small size without causing the above-described problems. The present embodiment will now be described illustrating a specific example.

In the present embodiment, the fixing roller 95 has an inverse-crown shape in which the outer diameter gradually increases from the center toward the ends. The outer diameter $D_1$ at the center is 30.0 mm. The outer diameter has the largest value $D_2$ ($D_3$)=30.15 mm at a position 102 mm from the center. The outer diameter has a decreasing tapered shape from that position, and has a value of $D_2$ ($D_3$)=29.75 mm (corresponding to the A4 size and the LTR size) at a position 112 mm from the center. On the other hand, the pressing roller 101 has a straight shape having a constant outer diameter from the center to the ends. The outer diameter at the center is 30.0 mm. A partial tapered portion is provided from a position 85 mm to a position 95 mm from the center corresponding to the B5 size and the EXE size. The outer diameter $D_6$ ($D_7$) at the position of 95 mm is 29.6 mm. In the present embodiment, the thickness of the core bar of the fixing roller 95 is 1.5 mm.

By using such a heating fixing device, it is possible to prevent corrugation at end portions of the recording material for respective sizes of recording materials. Furthermore, since the tapered portions corresponding to small-size recording materials present within the image region of the largest-size recording material are provided an the pressing roller, it is possible to remove adverse influences on the obtained image even if the above-described thin fixing roller is used. Adverse influences on the obtained image may, of course, be prevented even if tapered portions are provided at all positions corresponding to the ends of recording materials of respective sizes. However, since the pressing roller is generally pressed by excessive loads at two end portions thereof, the amount of deformation of the rubber layer at the two end portions is large due to bending of the pressing roller. Investigation made by the present inventors has shown that it is difficult to obtain the above-described effects for corrugation at end portions of the recording material even if the above-described tapered portions corresponding to the recording material of the largest size are provided at the pressing roller. Accordingly, as in the present embodiment, it is preferable to provide tapered portions corresponding to the ends of recording materials of small sizes at the pressing roller, and to provide tapered portions corresponding to the ends of recording materials of large sizes at the fixing roller.

In the above-described fourth through ninth embodiments, it is effective to configure the outer shape of the fixing roller by uniformly providing a resin layer conforming to the shape of the core bar.

Tenth Embodiment

Figure 19:
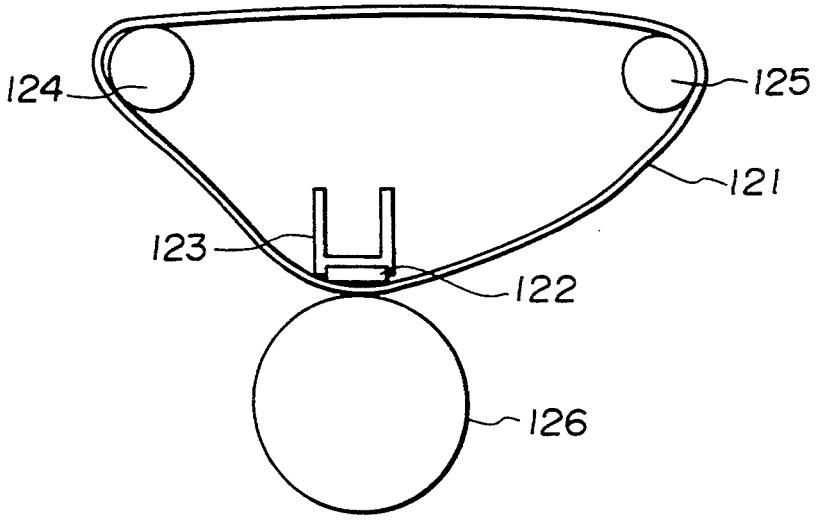
FIG. 19 is a diagram illustrating the schematic configuration of a heating fixing device according to a tenth embodiment of the present invention.
Figure 20:
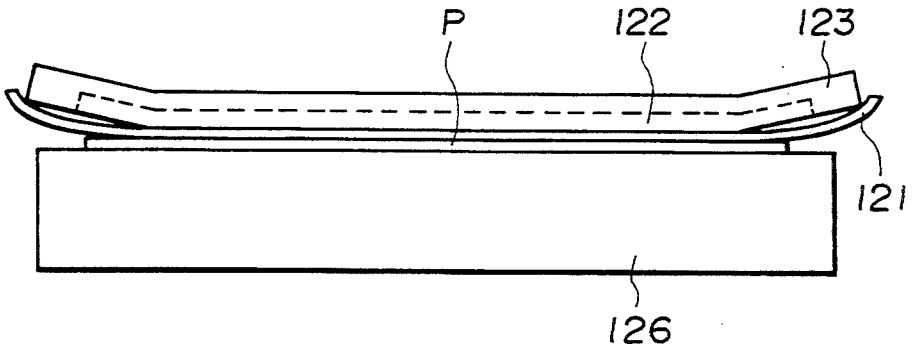
FIG. 20 is a diagram illustrating the configuration of the heating fixing device, as seen from the longitudinal direction, shown in FIG. 19.

Next, a tenth embodiment of the present invention will be described with reference to FIGS. 19 and 20.

The present embodiment relates to the shapes of a heater 122 and a heater holder 123 when a thin film 121 is used in a heating fixing device as a heating rotating member. The heater 122 and the heater holder 123 are gradually separated from a pressing roller 126 as they reach the ends of the recording material.

The heating film 121 comprises a fluororesin layer, made of PFA, PFTE or the like, 20 μm thick coated on a polyimide-film tube 30 μm thick having an inner diameter of 40 mm. The heater 122 having a heating pattern of a heating resistor, made of Ag/Pd or the like, provided on a ceramic substrate, made of alumina or the like, having high heat conductance, which is made by screen printing or the like, is provided on the heater holder 123 made by a heatresistant resin, such as phenol, a liquid-crystal polymer, PPS or the like. The heating film 121 is rotatably driven by a driving roller 124 and a tension roller 125. The pressing roller 126 is in pressure contact with the heating film 121 by a spring (not shown). Since the heat capacity of the heating member is very small according to the above-described configuration, it is possible to provide an energy-saving-type heating fixing device, in which the temperature rises very rapidly, current supply to the heater can be interrupted in a non-operating state, and the current supply can be performed only during a printing operation. In such a heating fixing device, in order to prevent corrugation at end portions of the recording material, as shown in FIG. 20, the heater 122 and the heater holder 123 are separated from the pressing roller 126 from the neighborhood of the positions corresponding to the ends of the recording material. At that time, the range of numerical values for the inclination described in the fourth embodiment can be applied to the inclination of the heater 122 separated from the pressing roller 126 without modification. More specifically, in the present embodiment, in order to deal with the LTR size, the heater 122 is separated from the pressing roller 126 with an inclination of 0.04 mm per mm from a position 105 mm from the position corresponding to the center of the image. As a result, the nip formed by the heater 122 and the pressing roller 126 via the heating film 121 has the same shape as that described in the fourth embodiment. That is, the width of the nip gradually increases from the center to the position where the heater 122 starts to separate from the pressing roller 126 due to bending of the heater 122 and the pressing roller 126, gradually decreases from the above-described position, and has substantially the same width as that of the center at end portions of the recording material. Corrugation at end portions of the recording material is considered to be produced by the following reasons. That is, since the nip width at end portions of the recording material is greater than the nip widths at other portions, a strong stress is applied to the end portions of the recording material. At the same time, since the conveying speed of the end portions of the recording material is greater than the conveying speeds of other portions, the end portions of the recording material slip within the nip region, thereby causing corrugation at the end portions of the recording material. As a result of investigation in the present embodiment, it can be considered that this phenomenon arises not only when the outer diameter of the fixing roller has an inverse-crown shape, but also when differences are present in the circumferential speed between various portions of the recording material while the fixing roller is actually rotating in pressure contact with the pressing roller depending on the shape of the nip. In the present embodiment, since the above-described shape of the nip can be obtained, the functions and effects described in the fourth embodiment can also be obtained.

Eleventh Embodiment

Next, an eleventh embodiment of the present invention will be described with reference to FIG. 21.

Figure 21:
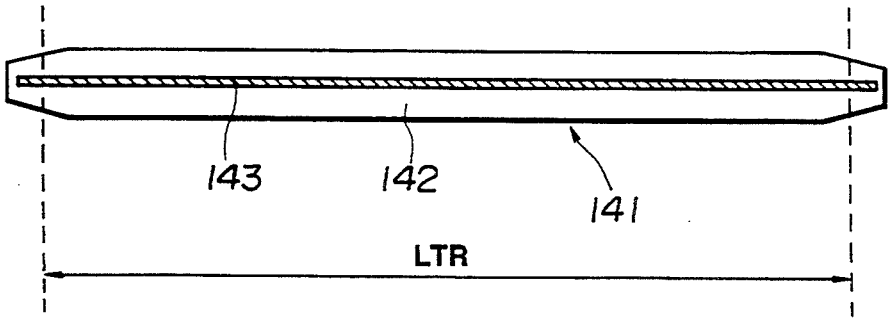
FIG. 21 is a diagram illustrating the shape of a heater according to an eleventh embodiment of the present invention.

FIG. 21 is a diagram illustrating the shape of a heater used in a heating fixing device according to the eleventh embodiment. As in the above-described tenth embodiment, the present embodiment relates to a heating fixing device in which a thin film is used as a heating rotating member. A nip is formed between a pressing roller and a heater 141 via the heating film, and the width of the heater 141 is arranged to be gradually reduced toward end portions of the recording material.

Since the heating fixing device of the present embodiment has the same cross section as the heating fixing device of the tenth embodiment, a description thereof will be omitted. As shown in FIG. 21, the heater 141, which is a Feature of the present embodiment, includes an alumina sheet, serving as a heater base, whose width is gradually reduced from positions inside the ends of the recording material toward the ends of the heater, and a nip having the above-described desired shape is obtained because of the following reason. That is, in the configuration of the heater 141, heat generated by a heating member 143 can quickly warm the entire heater base 142 because of high heat conductance of alumina, serving as the material for the heater base 142. Hence, the shape of the nip formed between the pressing roller and the heater 141 via the heating film is determined by the shape of the heater base 142 when the region of pressure contact with the pressing roller covers the entire heater.

More specifically, the heater base 142 has a width of 5 mm from the center of the recording material to positions inside the ends of the recording material by 4 mm (104 mm from the center in the case of the LTR size). The width is reduced from that positions with an inclination of 0.5 mm per mm. Thus, a shape, in which the nip width is gradually reduced toward end portions of the recording material, can be obtained. As a result, the same functions and effects as those described in the above-described embodiments can be obtained. According to investigation made by the inventors of the present application, the above-described functions and effects can be obtained when the inclination, with which the width of the heater base 142 is reduced toward end portions of the recording material, equals at least 0.2 mm per mm. The upper limit of the inclination is determined by the limit of permissible fixability at the end portions. According to the investigation, fixability which causes no practical problem was obtained with the values of inclination equal to or less than 1.2 mm per mm. As described above, according to the present embodiment, the above-described functions and effects can be obtained by changing the shape of the nip only by changing the width of the heater, and therefore no force to bend the recording material is exerted. Hence, there is no possibility of adverse influences on the obtained image, and recording materials having small sizes can be easily dealt with.

The individual components shown in outline or designated by blocks in the drawings are all well known in the fixing device arts and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fixing device comprising:

a fixing rotating member comprising a core material and a resin layer provided thereon; and a pressing rotating member comprising a rubber layer for forming a nip with said fixing rotating member, wherein a fixing operation is performed by grasping and conveying a recording material carrying an unfixed image by the nip, wherein said core material of said fixing rotating member has two largest-diameter portions respectively located between a central portion and each end portion of said fixing rotating member, within a region where a recording material of a largest size passes, and the diameter of the core material is gradually reduced from each largest-diameter portion toward the central portion and toward the nearest end portion, and wherein the outer shape of said fixing rotating member conforms to the shape of said core material.

2. A fixing device according to claim 1, wherein said resin layer of said fixing rotating member comprises a releasing layer.

3. A fixing device according to claim 1, wherein the hardness of said pressing rotating member is equal to or less than 70°.

4. A fixing device according to claim 3, wherein the hardness of said pressing rotating member is equal to or less than 60°.

5. A fixing device according to claim 1, wherein said pressing rotating member has substantially an inverse-crown shape.

6. A fixing device according to claim 1, wherein said pressing rotating member has substantially a straight shape.

7. A fixing device according to claim 1, wherein said pressing rotating member comprises a releasing layer forming a surface thereof.

8. A fixing device according to claim 7, wherein the hardness of said pressing rotating member is at least 30°.

9. A fixing device according to claim 8, wherein the hardness of said pressing rotating member is at least 40°.

10. A fixing device according to claim 1, wherein the outer diameter of said fixing rotating member is equal to or less than 30 mm.

11. A fixing device comprising:

a fixing rotating member for contacting an unfixed image; and a pressing rotating member, having a hardness less than the hardness of said fixing rotating member, for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein said pressing rotating member has one of a substantially straight shape and a substantially inverse-crown shape.

12. A fixing device according to claim 11, wherein the hardness of said pressing rotating member is at least 30° and equal to or less than 70°.

13. A fixing device according to claim 11, wherein said pressing rotating member comprises a releasing layer forming surface thereof.

14. A fixing device according to claim 11, wherein the outer diameter of said fixing rotating member is equal to or less than 30 mm.

15. A fixing device comprising:

a fixing rotating member for contacting an unfixed image; and a pressing rotating member, having a hardness less than the hardness of said fixing rotating member, for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein the hardness of said pressing rotating member is at least 30° and equal to or less than 70°.

16. A fixing device according to claim 15, wherein said pressing rotating member has one of a substantially straight shape and a substantially inverse-crown shape.

17. A fixing device according to claim 15, wherein said pressing rotating member comprises a releasing layer forming a surface thereof.

18. A fixing device according to claim 15, wherein the outer diameter of said fixing rotating member is equal to or less than 30 mm.

19. A fixing device comprising:

a fixing rotating member for contacting an unfixed image; and a pressing rotating member, having a hardness less than the hardness of said fixing rotating member, for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein the outer diameter of said fixing rotating member is equal to or less than 30 mm.

20. A fixing device according to claim 19, wherein said pressing rotating member comprises a releasing layer forming a surface thereof.

21. A fixing device according to claim 19, wherein the hardness of said pressing rotating member is at least 30° and equal to or less than 70°.

22. A fixing device according to claim 19, wherein said pressing rotating member has one of a substantially straight shape and a substantially inverse-crown shape.

23. A fixing device comprising:

a fixing rotating member for contacting an unfixed image; and a pressing rotating member for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein the inclination of said fixing rotating member from each largest-diameter portion toward the nearest end portion is at least 0.02 and equal to or less than 0.2.

24. A fixing device according to claim 23, wherein the inclination is preferably at least 0.03 and equal to or less than 0.15.

25. A fixing device according to claim 23, wherein said fixing rotating member comprises a core material having two largest-diameter portions respectively located between a central portion and each end portion of said fixing rotating member, within a region where a recording material having a largest size passes, and wherein the diameter of the core material is gradually reduced from each largest-diameter portion toward the central portion and toward the nearest end portion.

26. A fixing device according to claim 25, wherein the outer shape of said fixing rotating member conforms to the shape of said core material.

27. A fixing device comprising:

a fixing rotating member for contacting an unfixed image; and a pressing rotating member for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein the inclination of said fixing rotating member from each largest-diameter portion toward the nearest end portion is at least 20 times and equal to or less than 300 times the inclination of said fixing rotating member from each largest-diameter portion toward the central portion.

28. A fixing device according to claim 27, wherein said pressing rotating member comprises a releasing layer forming a surface thereof.

29. A fixing device according to claim 27, wherein the inclination of said fixing rotating member from each largest-diameter portion toward the nearest end is at least 0.02 and equal to or less than 0.2.

30. A fixing device according to claim 27, wherein said fixing rotating member comprises a core material having two largest-diameter portions respectively located between a central portion and each end portion of said fixing rotating member, within a region where a recording material having a largest size passes, and wherein the diameter of the core material is gradually reduced from each largest-diameter portion toward the central portion and toward the nearest end portion.

31. A fixing device according to claim 30, wherein the outer shape of said fixing rotating member conforms to the shape of said core material.

32. A fixing device comprising:

a fixing rotating member for contacting an unfixed image; and a pressing rotating member for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein the inclination of said fixing rotating member from each largest-diameter portion toward the nearest end portion is constant or increases toward the nearest end portion.

33. A fixing device according to claim 32, wherein said fixing rotating member comprises a core material having a thickness equal to or less than 2 mm.

34. A fixing device according to claim 32, wherein the inclination of said fixing rotating member from each largest-diameter portion toward the nearest end is at least 0.02 and equal to or less than 0.2.

35. A fixing device according to claim 32, wherein the inclination of said fixing rotating member from each largest-diameter portion toward the nearest end portion is at least 20 times and equal to or less than 300 times the inclination of said fixing rotating member from each largest-diameter portion toward the central portion.

36. A fixing device according to claim 32, wherein said fixing rotating member comprises a core material having two largest-diameter portions respectively located between a central portion and each end portion of said fixing rotating member, within a region where a recording material having a largest size passes, and wherein the diameter of the core material is gradually reduced from each largest-diameter portion toward the central portion and toward the nearest end portion.

37. A fixing device according to claim 36, wherein the outer shape of said fixing rotating member conforms to the shape of said core material.

38. A fixing device comprising:

a fixing rotating member for contacting an unfixed image; and a pressing rotating member for forming a nip with said fixing rotating member, wherein a fixing operation is performed by grasping and conveying a recording material carrying the unfixed image by the nip, and wherein the diameter of said fixing rotating member is gradually reduced, in a direction toward a nearest end portion of said fixing rotating member, at each portion corresponding to a region where an end portion of one of a plurality of recording materials having different sizes passes through the nip.

39. A fixing device according to claim 38, wherein a change in the diameter of said fixing rotating member at a portion corresponding to a region where an end of a recording material passes through the nip increases as the size of the recording material increases.

40. A fixing device according to claim 38, wherein said pressing rotating member comprises a releasing layer forming a surface thereof.

41. A fixing device comprising:

a fixing rotating member for contacting an unfixed image; and a pressing rotating member for forming a nip with said fixing rotating member, wherein a fixing operation is performed by grasping and conveying a recording material carrying the unfixed image by the nip, wherein said fixing rotating member has two largest-diameter portions respectively located between a central portion and each end portion of said fixing rotating member, within a region where a recording material of a largest size passes, and the diameter of said fixing rotating member is gradually reduced from each largest-diameter portion toward the central portion and toward the nearest end portion, and wherein the diameter at predetermined portions of said pressing rotating member decreases toward the nearest end portion of said pressing rotating member.

42. A fixing device according to claim 41, wherein the predetermined portions of said pressing rotating member correspond to regions where ends of a recording material having a size different from the largest recording material size pass through the nip.

43. A fixing device according to claim 41, wherein the inclination of said fixing rotating member from each largest-diameter portion toward the nearest end portion is at least 0.02 and equal to or less than 0.2.

44. A fixing device according to claim 41, wherein the inclination of said fixing rotating member from each largest-diameter portion toward the nearest end portion is at least 20 times and equal to or less than 300 times the inclination of said fixing rotating member from each largest-diameter portion toward the central portion.

45. A fixing device according to claim 41, wherein the inclination of said fixing rotating member from each largest-diameter portion toward the nearest end portion is constant or increases toward the end nearest of said fixing rotating member.

46. A fixing device according to claim 41, wherein said fixing rotating member comprises a core material having two largest-diameter portions respectively located between a central portion and each end portion of said fixing rotating device, within a region where a recording material having a largest size passes, and wherein the diameter of the core material is gradually reduced from each largest-diameter portion toward the central portion and toward the nearest end portion.

47. A fixing device according to claim 46, wherein the outer shape of said fixing rotating member conforms to the shape of said core material.

48. An image fixing apparatus comprising:

a heater;

a movable film in contact with said heater and movable together with a recording material carrying an image to be fixed; and a pressing member for forming a nip with said heater through said film, wherein said heater is gradually separated from said pressing member in a direction toward a nearest end portion of said heater at the positions corresponding to the ends of the recording material.

49. An image fixing apparatus comprising:

a heater;

a movable film in contact with said heater and movable together with a recording material carrying an image to be fixed; and a pressing member for forming a nip with said heater through said film, wherein the width of said heater is gradually reduced toward a nearest end portion of said heater at the positions corresponding to the ends of the recording material.

* * * * *

UNITED STATES PATENT AND TRADEMARK OFFICE

CERTIFICATE OF CORRECTION

PATENT NO. : 5,450,181

DATED : September 12, 1995

INVENTOR(S) : SHINICHI TSUKIDA, ET AL.

It is certified that error appears in the above-indentified patent and that said Letters Patent is hereby corrected as shown below:

Column 1,
line 28, "has" should be deleted;
line 29, "a" (first occurrence) should be deleted, and "has a" should be deleted; and
line 42, "largest-diameter," should read --largest-diameter portions,--.

Column 3,
line 26, "of" (second occurrence) should be deleted; and
line 47, "innside" should read --inside--.

Column 10,
line 12, "20.28mm," should read --20.25mm,--.

Column 11,
line 64, "29.8" should read --29.6--.

Column 12,
line 45, "two ." should read --two.--; and
line 66, "expermental" should read --experimental--.

Column 13,
line 58, "8" should read --6--.

UNITED STATES PATENT AND TRADEMARK OFFICE

CERTIFICATE OF CORRECTION

PATENT NO. : 5,450,181

DATED : September 12, 1995

INVENTOR(S) : SHINICHI TSUKIDA, ET AL.

It is certified that error appears in the above-indentified patent and that said Letters Patent is hereby corrected as shown below:

Column 16,
line 5, "8" should read --6--;
line 15, "the" should read --the supply of--;
line 16, "supply of" should be deleted; and
line 42, "Circular" should read --circular--.

Column 19,
line 10, "shapes" should read --shape,--.

Column 20,
line 58, "an" should read --on--.

Column 21,
line 58, "position" should read --position of--.

Column 22,
line 60, positions" should read --position--.

Column 23,
line 64, "has" should read --has a--, and "an" should be deleted; and
line 67, "substantially a" should read --a substantially--.

Column 24,
line 38, "forming" should read --forming a--.

UNITED STATES PATENT AND TRADEMARK OFFICE

CERTIFICATE OF CORRECTION

PATENT NO. : 5,450,181

DATED : September 12, 1995

INVENTOR(S) : SHINICHI TSUKIDA, ET AL.

It is certified that error appears in the above-indentified patent and that said Letters Patent is hereby corrected as shown below:

Column 26,
line 29, "end" should read --end portion--.

Column 27,
line 1, "end" should read --end portion--.

Column 28,
line 23, "end nearest" should read --nearest end--.

Signed and Sealed this

Twenty-third Day of January, 1996

Bruce Lehman

*Attest:*

BRUCE LEHMAN

*Attesting Officer*

*Commissioner of Patents and Trademarks*